United States Patent [19]

McCoy et al.

[11] 4,003,719

[45] Jan. 18, 1977

[54] SCHIFF BASES AS BIOCIDES IN PETROLEUM PRODUCTS

[75] Inventors: David R. McCoy; Raymond Cadorette; George W. Eckert, all of Wappingers Falls, N.Y.

[73] Assignee: Texaco Inc., New York, N.Y.

[22] Filed: Feb. 5, 1975

[21] Appl. No.: 547,279

[52] U.S. Cl. ..... 44/63; 44/73

[51] Int. Cl.[2] ..... C10L 1/22

[58] Field of Search ..... 44/73, 63; 424/325; 252/392

[56] References Cited

UNITED STATES PATENTS

| | | | |
|---|---|---|---|
| 2,284,267 | 5/1942 | Downing et al. | 44/73 |
| 2,301,861 | 11/1942 | Downing et al. | 44/73 |
| 2,700,682 | 1/1955 | Blomberg et al. | 44/73 |
| 2,990,266 | 6/1961 | Eden | 424/325 |
| 3,053,645 | 9/1962 | Cole | 44/73 |
| 3,147,307 | 9/1964 | Moss et al. | 424/325 |
| 3,628,926 | 12/1971 | Eckert et al. | 44/63 |

*Primary Examiner*—Allen B. Curtis
*Assistant Examiner*—Y. Harris-Smith
*Attorney, Agent, or Firm*—T. H. Whaley; C. G. Ries; Henry W. Archer

[57] ABSTRACT

A composition for preventing the growth of microorganisms in petroleum hydrocarbons in contact with water by incorporating from about 0.05 to 0.1 per cent by volume of a hydrocarbon soluble Schiff base having less than 20 carbon atoms per hetero atom.

2 Claims, No Drawings

SCHIFF BASES AS BIOCIDES IN PETROLEUM PRODUCTS

BACKGROUND OF THE INVENTION

1. Field of the Invention

This invention relates to the preservation of petroleum products and like substances in storage, and more particularly to the inhibition of the action of micro-organisms on petroleum and other materials subject to metabolism by micro-organisms present in the water layer in vessels and in storage tanks.

2. Description of the Prior Art

In petroleum product storage and handling facilities, such as storage tanks, pipelines, fuel lines and other equipment, petroleum products often may be in contact with water containing micro-organisms. This is particularly true in the case in oil storage tanks where a water layer usually is provided in the bottom of the tank to insure against loss by leakage, the water being replenished as necessary. Micro-organisms such as bacteria, yeast, molds, actinomyces, etc., generally are present in such tank bottom water, the organisms usually being a type which functions most effectively in the interface between the stored material and water to metabolize the hydrocarbons or constituents thereof. This metabolism not only results in loss of petroleum material but in the case of refined products it is also undesirable in other respects in that it commonly causes discoloration of the product, formation of hydrogen sulfide and undesirable gummy substances, formation of peroxides which effect the oxidation susceptibility of the petroleum product, and formation of many other undesirable compounds, such as acids. Discoloration in the case of light colored petroleum products is highly undesirable and in some cases, as with so-called white distillates or kerosene fractions, the discoloration can be so severe as to require re-refining of the product. Where additives are present in the petroleum, as is usually the case with gasoline and lubricating oils, the formation of gummy substances may represent loss of such additives or undesirable conversion thereof. Obviously, such microbial activity also is harmful to the tank structure as well since such tanks usually are formed of metal.

In the prior art, it is known to inhibit the growth of micro-organisms present in water to contact with petroleum products by means of a biocide, usually added to the water phase. Although such water phase biocides are available and have been used for controlling the growth of micro-organisms in storage tanks, their use is not feasible under conditons where access to the water phase is impractical, as in wing tanks of airplanes and in fuel lines. In such situations a hydrocarbon phase biocide is desirable. However, it is important that any such materials added to a petroleum fraction or product should not adversely affect its properties. This is particularly essential when the petroleum material is a refined or finished product.

Previously suggested hydrocarbon phase biocides are cyclic imines described in coassigned U.S. Pat. No. 3,628,926 and N-alkyl-substituted-1,3-propane-diamines in coassigned U.S. Pat. No. 3,719,458.

SUMMARY OF THE INVENTION

The present invention resides in the unexpected and unobvious discovery that the incorporation of as little as 0.05 volume percent of a Schiff base as hereinafter defined will effectively inhibit the growth of microorganisms in water-containing hydrocarbon fuels. The compounds found effective in the process of this invention are Schiff bases having less than 20 carbon atoms per hetero atom and in particular those of the formula:

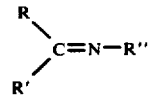

wherein R and R′ are hydrogen, alkyl having up to 6 carbon atoms, phenyl or salicyl and R″ is alkyl having up to 6 carbon atoms, hydroxyalkyl hydroxyalkoxyalkyl, or alkylaminoalkyl with the proviso that only one of R, R‴ and R⁗ are hydrogen.

The Schiff bases are easily prepared by heating a primary amine with an aldehyde (or ketone) and azeotroping off the water of reaction. The Schiff bases show varying degrees of effectiveness as biocides. It is believed that increasing the molecular weight or increasing aromaticity decreases solubility in water and thereby decreases effectiveness as a biocide. Some water solubility obviously is necessary.

A hydrocarbon fuel composition in accordance with the invention can consist of any light distillate hydrocarbon fraction boiling in the gasoline and/or kerosene boiling ranges. The fuel can consist of paraffinic, naphthenic and/or aromatic hydrocarbons or mixture thereof suitable for use in either a spark-ignited or a turbine internal combustion engine. The base fuels are obtained from the distillation of crude oil, by the catalytic or thermal cracking of gas oils, by the alkylation of isoparaffins with olefins, or by the polymerization of olefins. The boiling range of the base fuel will generally be in the range from 70° to 625° F. Motor fuel or gasoline generally boils from about 90° to 425° F. and kerosene base or turbine fuels generally boils from about 325° to 625° F. The base fuel composition can also contain additives conventionally employed in gasoline or kerosene, such as anti-oxidants, stabilizers dyes, anti-icing additives and the like.

The fuel compositions of the invention were tested for their bactericidal property according to the following procedure: a sample of water was inoculated with a portion of a blood agar microorganism culture of typical micro-organisms obtained from the water bottoms of a mineral fuel oil storage tank. Five cc of the inoculated water was covered with 20 cc of the fuel sample to be tested in a one ounce bottle. The stoppered bottle was maintained at room temperature for 5 days with daily agitation. At the end of this time approximately one drop of the water phase was placed on a blood agar plate which was then maintained at room temperature for 5 days or until a growth occurred, whichever came first. A control fuel (one not containing a biocide) was tested concurrently with fuel sample containing potential biocides.

The explanatory data of Table I lists typical Schiff bases while Table II lists the results obtained at various concentrations with these compounds.

The explanatory data of Table III shows the effectiveness as rust inhibitors of certain Schiff bases.

The present invention is applicable to Jet Fuels in general. This includes the Jet Fuels covered by Standard Specifications listed for both types, e.g. Jet Fuel A and Jet Fuel B under ASTM D-1655-73.

A typical Avjet B composition is:

| DISTILLATION | |
|---|---|
| IBP ° F. | 134 |
| 10% | 194 |
| 30% | 264 |
| 50% | 352 |

-continued

| DISTILLATION | |
|---|---|
| 90% | 442 |
| 95% | 470 |
| E.P. | 498 |

API Gravity 51.9; Flash 76° F.; FIA Anal. = Aromatics 8%; Olefins 2%; Saturates 90%; Freezing Point, below −76° F.

TABLE I

STRUCTURE OF SCHIFF'S BASES TESTED AS BIOCIDES

1. N-Benzylidenemethylamine — $C_6H_5CH{=}NCH_3$

2. $C_{11-13}$ Alkyliminoethanol — 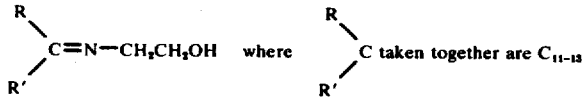

3. $C_{11-13}$ Alkyliminoethoxyethanol — 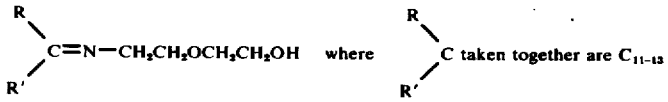

4. 2/1 $C_{11-13}$ Ketone/Tetraethylenepentamine Schiff Base — 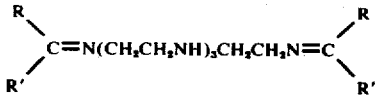

where R—C—R' taken together are $C_{11-13}$

5. $C_{11-13}$ Alkyliminopropyl morpholine — 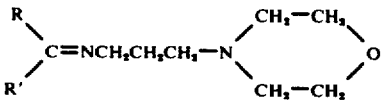

where R—C—R''' taken together are $C_{11-13}$ 6. 4-($C_{11-13}$ alkyliminomethyl)piperidine — 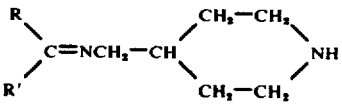

where 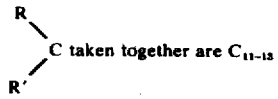

TABLE II

RESULTS OF CULTURE TESTS ON AVJET B CONTAINING SCHIFF BASE

| Schiff Base in Avjet B | Results of Culture Tests at 0.5% | at 0.10% | at .05% | at .02% | at .01% |
|---|---|---|---|---|---|
| 1 | | No Growth | No Growth | | |
| 2 | No Growth | No Growth | Growth | | |
| 3 | No Growth | | | | |
| 4 | | No Growth | No Growth | | Growth |
| 5 | No Growth | No Growth | | | Growth |
| 6 | | No Growth | No Growth | | Growth |

TABLE III

RESULTS OF RUST TESTS ON AVJET B CONTAINING SCHIFF'S BASES

| Schiff Base in Avjet B | Amount of Additive In the Fuel-Volume | Accelerated Rust Test[1] % Rust Fuel Layer | Water Layer |
|---|---|---|---|
| None (base fuel) | None | 30 to 40 | 100 |
| N-Benzylidenemethylamine | 0.10 | 10 | 0 |
| N-Benzylidenemethylamine | 0.02 | 10 | 0 |
| $C_{11-13}$ Alk liminoethanol | 0.10 | 0 | 0 |
| $C_{11-13}$ Alkyliminoethanol | 0.02 | 0 | 0 |
| $C_{11-13}$ Alkyliminoethoxyethanol | 0.10 | 0 | 0 |
| $C_{11-13}$ Alkyliminoethoxyethanol | 0.02 | 0 | 0 |
| 2/1 $C_{11-13}$ Ketone/Tetraethylenepentamine Schiff Base | 0.10 | 0 | 0 |
| 2/1 $C_{11-13}$ Ketone/Tetraethylenepentamine Schiff BAse | 0.02 | 0 | 0 |
| N-($C_{11-13}$ Alkyliminopropyl)-morpholine | 0.10 | 0 | 0 |
| N-($C_{11-13}$ Alkyliminopropyl)-morpholine | 0.02 | 0 | 0 |

[1] 90cc fuel plus 20cc distilled water; cold-rolled steel; 24 hours at room temperature

What is claimed is:

1. A fuel composition comprising a mixture of hydrocarbons boiling in the range of about 70° to 625° F. containing from about 0.05 to 0.1 volume percent of at least one hydrocarbon soluble Schiff base selected from the group consisting of:

N-Benzylidenemethylamine;

an alkyliminoethanol of the formula:

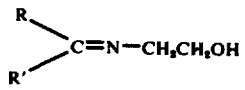

wherein

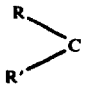

taken together, form an alkyl group having from 11 to 13 carbon atoms;

an alkyliminoethoxyethanol of the formula:

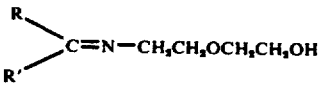

wherein R and R', taken together, form an alkyl group having from 11 to 13 carbon atoms; an imino ethoxylate of the formula:

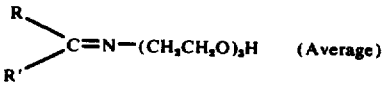

wherein

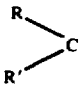

taken together form an alkyl group having 11 to 13 carbon atoms; a tetraethylenepentamine base of a ketone of the formula:

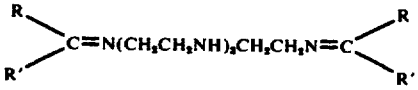

wherein

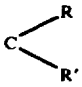

taken together form an alkyl group having from 11 to 13 carbon atoms; and, an alkyliminopropyl morpholine of the formula:

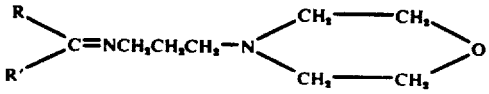

wherein

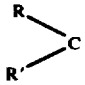

taken together form an alkyl group having from 11 to 13 carbon atoms.

2. The composition of claim 1, wherein said mixture is a jet fuel.

* * * * *